United States Patent [19]

Straza et al.

[11] 3,952,575

[45] Apr. 27, 1976

[54] BELLOWS FORMING APPARATUS

[75] Inventors: George T. Straza; Edward L. Parr, both of El Cajon, Calif.

[73] Assignee: Straza Enterprises Ltd., El Cajon, Calif.

[22] Filed: Jan. 30, 1975

[21] Appl. No.: 545,337

[52] U.S. Cl. ..... 72/393; 72/370; 72/392

[51] Int. Cl.[2] ..... B21D 41/02

[58] Field of Search ..... 72/393, 392, 370, 367, 72/59; 113/116 B, 116 R; 29/454; 269/48.1

[56] References Cited

UNITED STATES PATENTS

| | | | |
|---|---|---|---|
| 1,825,030 | 9/1931 | Vaughn | 72/393 |
| 2,089,476 | 8/1937 | Grotnes | 72/393 |
| 2,435,306 | 2/1948 | Grotnes | 72/393 X |

*Primary Examiner*—C. W. Lanham
*Assistant Examiner*—James R. Duzan
*Attorney, Agent, or Firm*—Brown & Martin

[57] ABSTRACT

Apparatus for forming circumferential corrugations in a thin wall tube to produce a cylindrical bellows. The tube is supported on a rigid sleeve to prevent distortion, but is free to move axially as each corrugation is formed by an expanding mandrel which extends through a circumferential channel in the sleeve to form a complete ring. The mandrel is composed of interfitting wedge elements, alternate elements of which move radially more than the others to accommodate the expansion and contraction, a common multiple cam actuator providing the driving force on all elements simultaneously.

4 Claims, 4 Drawing Figures

BELLOWS FORMING APPARATUS

BACKGROUND OF THE INVENTION

Cylindrical type bellows are usually made either by a rolling process, or by radial expansion forming of successive corrugations. In the rolling process the entire tube being formed is rotated between shaped rolls to form each corrugation, the operation being slow and the apparatus cumbersome.

Expansion type machines have used a variety of mechanisms to form corrugations by stretching the tube outwardly with segmented mandrel elements. The tube is often inadequately supported due to the configuration and action of the mandrel, and distortion can occur. In some machines the mandrel does not form a complete ring when expanded and it may be necessary to rotate the tube to more than one position to form satisfactory corrugations.

SUMMARY OF THE INVENTION

The apparatus described herein forms complete and even corrugations in a thin wall tube, with a single action for each corrugation, to form a distortion free bellows of any desired length. The tube is firmly supported on a rigid sleeve, with movement limited to an axial draw as each corrugation is formed. A ring mandrel expands through a circumferential channel in the support sleeve and is composed of a plurality of wedge-like sections which, when fully expanded, form an unbroken ring having the cross section of the corrugation to be formed.

To accommodate the expansion and contraction in a single plane, some of the mandrel sections must move more than the others. Each section has individual guides and stops and all are moved simultaneously in the proper proportions by a multiple cam actuator, which is operated by a simple linear drive. The entire mechanism is simple and compact and requires only a single operating unit.

The primary object of this invention, therefore, is to provide a new and improved bellows forming apparatus.

Another object of this invention is to provide bellows forming apparatus which forms successive corrugations in a thin wall tube by internal expansion means.

A further object of this invention is to provide bellows forming apparatus having a single actuator which operates the expansion means in a single stroke for each forming action.

Other objects and advantages will be apparent in the following detailed description, taken in conjunction with the accompanying drawings, in which.

DESCRIPTION OF THE PREFERRED EMBODIMENT

Figure 1:
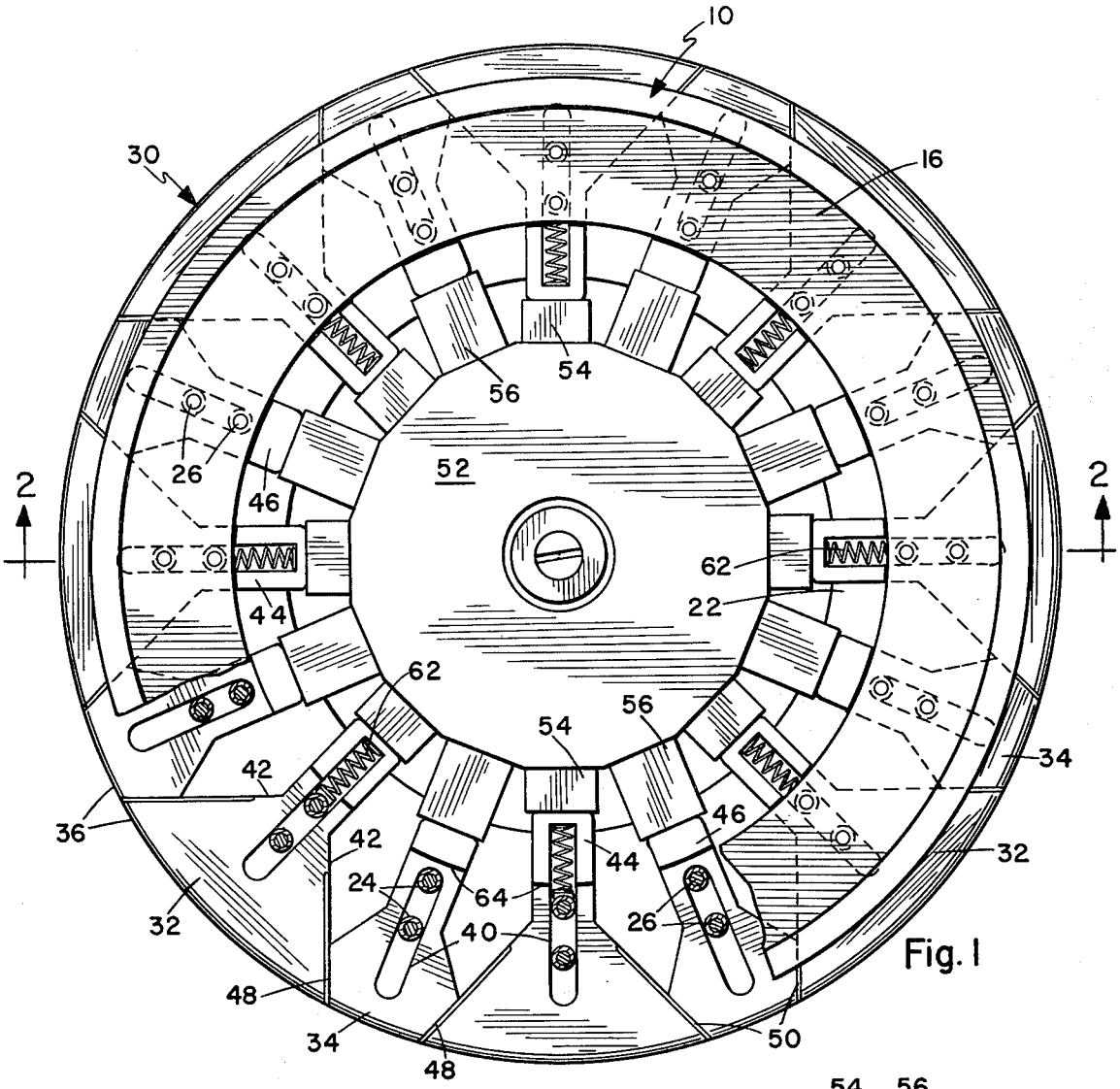
FIG. 1 is a top plan view, partially cut away, of the bellows forming apparatus with the mandrel expanded.

The apparatus is generally contained in a rigid cylindrical sleeve 10, comprising an upper sleeve 12 and a lower sleeve 14 of equal diameter. Upper sleeve 12 has an inwardly extending flange ring 16 at the lower end thereof, with a circular inner edge 18. On the lower end of lower sleeve is a base plate 20, and on top of the lower sleeve is a top ring 22 extending inwardly parallel to flange ring 16. The flange ring 16 and top ring 22 are separated by tubular spacers 24 and secured together by bolts 26 through the spacers to join the upper and lower sleeves into an integral sleeve assembly.

Figure 2:
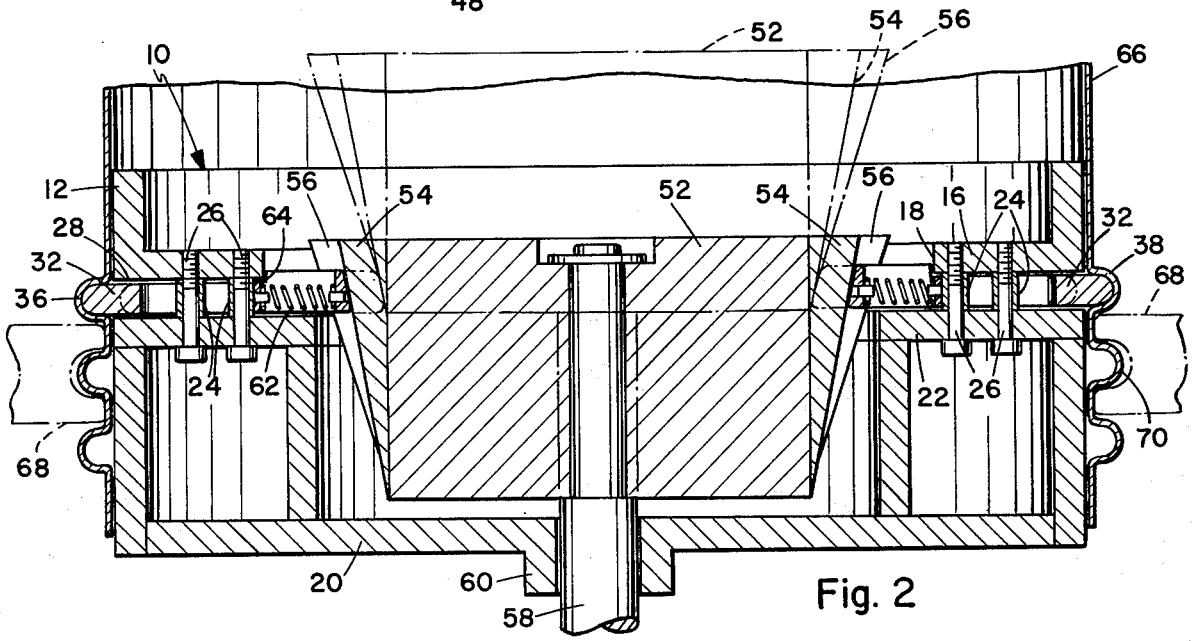
FIG. 2 is a sectional view taken on line 2—2 of FIG. 1, and with a partially formed bellows in place.

The space between flange ring 16 and top ring 22 forms a circumferential channel 28 in which the mandrel assembly 30 is radially slidable. The mandrel is composed of large primary sections 32 alternating with smaller secondary sections 34, each section having an outer peripheral edge 36 which is arcuate, with a radius equal to the inner radius of the bellows corrugation to be formed. In the expanded position of the mandrel, illustrated in FIGS. 1 and 2, the sections project radial from sleeve 10, and the peripheral edges 36 form a continuous ring having the cross section of the inner contour of the corrugation 38. As illustrated, the corrugations are semi-circular in cross section, but could be of any suitable configuration depending on the function of the bellows.

The bolts 26 and spacers 24 are arranged in circumferentially spaced radial pairs and each mandrel section has a radial slot 40, through which a pair of spacers pass and act as guides. Thus each mandrel section is guided and limited to radial sliding motion in channel 28 by a pair of the spacers 24.

Primary sections 32 each have outwardly divergent side faces 42 in a wedge-like configuration, and a radially inwardly extending tongue 44. Secondary sections 34 each have an inwardly extending tongue 46 and outwardly convergent side faces 48, which slide against the side faces 42 of the primary sections. To reduce friction and wear, the side faces 42 have inset wear strips 50 of plastic or other suitable material, on which the secondary sections slide.

The mandrel is driven by a cam plug 52 axially slidably mounted in sleeve 10. A round the periphery of cam plug 52 are primary cams 54 engaging tongues 44 of primary sections 32, and secondary cams 56 engaging tongues 46 of secondary sections 34. All of the cams are wedge-like and converge downwardly so that, as the cam plug moves down, the mandrel sections are forced outwardly. Since the circumference of the mandrel changes as it expands and contracts, the secondary sections 34 are made to move more than the primary sections, as in FIG. 3. Thus secondary cams 56 have a steeper inclination than primary cams 54, to provide the necessary difference in motion. Cam plug 52 is illustrated as being attached to a shaft 58, slidable in a bearing 60 on base plate 20. The shaft may be connected to any suitable linear actuator not shown, to provide a simple reciprocal action of the cams.

To retract the mandrel when the cam plug is raised, each primary section 32 has a return spring 62 inserted between the innermost spacer 24 and the inner end of the slot 40. The inward bias of the primary sections will retract the secondary sections, but the latter may also be spring assisted if necessary. For accurate alignment in the expanded position, each mandrel section preferably has a positive stop. As illustrated, each section has a raised shoulder 64 which stops against the inner edge 18 of flange ring 16 in the expanded position, but other stop means may be suitable.

Figure 3:
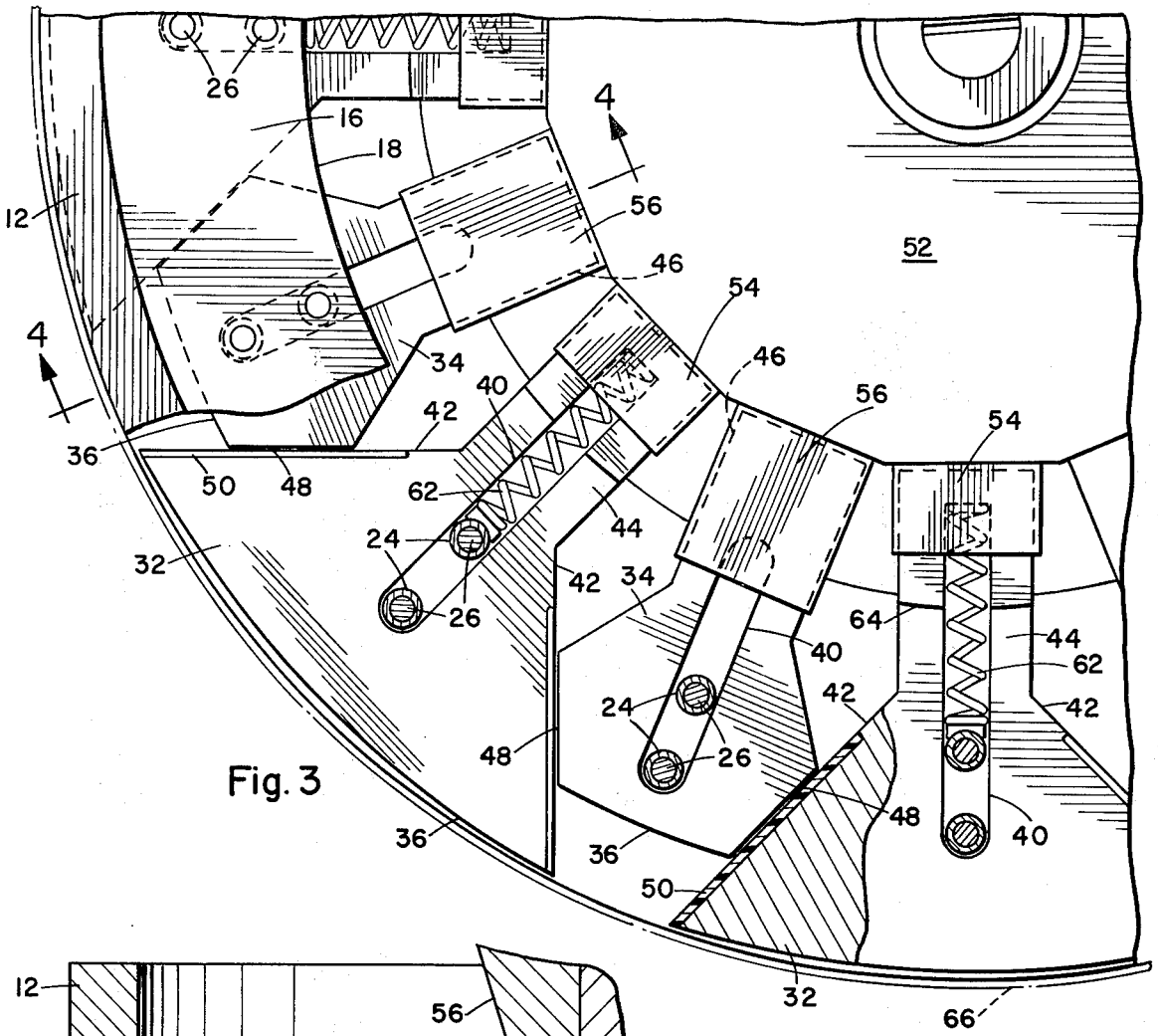
FIG. 3 is an enlarged top plan view, partially cut away, with the mandrel retracted.
Figure 4:
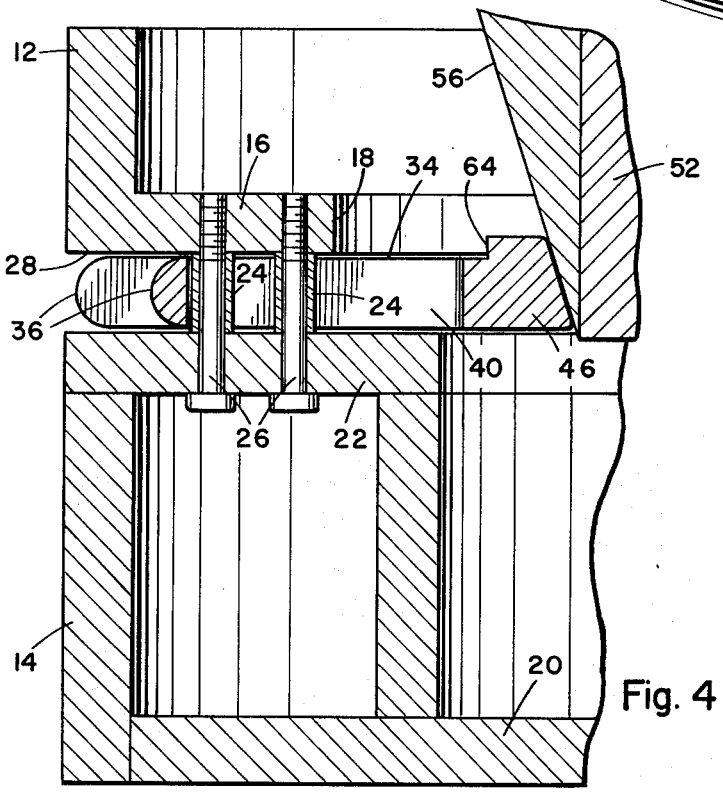
FIG. 4 is a sectional view taken on line 4—4 of FIG. 3.

In operation, the tube 66, which is to be formed into a bellows, is fitted over sleeve 10, with the mandrel 30 retracted, as in FIG. 3. Cam plug 52 is then pulled down, causing the cams to drive the mandrel sections outwardly and form the initial corrugation in the tube. With the tube supported on the sleeve, which is a close fit in the tube, the only motion of the tube is an axial draw to follow the outward displacement of the corrugation. A suitable lubricant may be used to minimize friction in the operation.

The mandrel 30 is then retracted by raising cam plug 52 and the tube 66 is advanced to the next position for a subsequent corrugation to be formed. Any convenient indexing means may be used to hold the tube, such as the clamps 68 shown in broken line in FIG. 2, which are recessed to receive the last formed corrugation 70. Manual or power operated means may be used to actuate the clamps, depending on the installation of the apparatus. The operation is repeated as necessary to produce a bellows with the required number of corrugations.

Having described our invention, we claim:

1. Bellows forming apparatus, comprising:

a rigid cylindrical sleeve for supporting, with a close axial sliding fit, a tube to be formed into a bellows, said sleeve having a radially opening circumferential channel, a mandrel composed of alternate primary and secondary sections radially slidably mounted in said channel, actuating means for moving said mandrel sections between a retracted position within the channel and an expanded position extending circumferentially from the channel, said primary and secondary sections interfitting and having edge portions which form, in the expanded position, an unbroken peripheral ring conforming to the inner contour of a bellows corrugation to be formed in the tube.

2. Bellows forming apparatus according to claim 1, wherein said secondary sections have a greater range of radial movement than the primary sections, and said actuating means including cams for simultaneously engaging and driving said sections individually through their respective ranges of motion.

3. Bellows forming apparatus according to claim 1, wherein said primary sections have outwardly divergent side faces, said secondary sections having outwardly convergent side faces in sliding contact with the divergent side faces, said secondary sections having a greater range of movement than said primary sections, and said actuating means including cams for simultaneously engaging and driving said sections individually through their respective ranges of motion.

4. Bellows forming apparatus according to claim 3, wherein said cams are fixed on a cam plug axially movably mounted in said sleeve, said cams having axially inclined faces for engagement with said sections, the faces of cams for said secondary sections having a steeper angle of inclination than the cams for said primary sections.

* * * * *